US006517394B2

(12) United States Patent
Ozawa

(10) Patent No.: US 6,517,394 B2
(45) Date of Patent: Feb. 11, 2003

(54) ENGINE CONTROL SYSTEM FOR WATERCRAFT

(75) Inventor: Shigeyuki Ozawa, Iwata (JP)

(73) Assignee: Sanshin Kogyo Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/908,364

(22) Filed: Jul. 18, 2001

(65) Prior Publication Data

US 2002/0045389 A1 Apr. 18, 2002

(30) Foreign Application Priority Data

Jul. 19, 2000 (JP) ..... 2000-219522

(51) Int. Cl.[7] ..... B63H 21/22
(52) U.S. Cl. ..... 440/1; 440/87
(58) Field of Search ..... 440/1, 87

(56) References Cited

U.S. PATENT DOCUMENTS

| | | | | |
|---|---|---|---|---|
| 4,903,662 A | | 2/1990 | Hirukawa et al. | |
| 5,062,401 A | | 11/1991 | Suganuma | |
| 5,117,792 A | | 6/1992 | Kanno | |
| 5,669,349 A | | 9/1997 | Iwata et al. | |
| 5,797,775 A | | 8/1998 | Ozawa et al. | |
| 5,826,557 A | | 10/1998 | Motoyama et al. | |
| 5,970,951 A | | 10/1999 | Ito | |
| 6,015,317 A | | 1/2000 | Hoshiba et al. | |
| 6,019,090 A | | 2/2000 | Ozawa | |
| 6,032,653 A | | 3/2000 | Anamoto | |
| 6,113,442 A | * | 9/2000 | Nakamura | 440/1 |
| 6,159,059 A | | 12/2000 | Bernier et al. | |
| 6,217,480 B1 | | 4/2001 | Iwata et al. | |

FOREIGN PATENT DOCUMENTS

CA 2207938 6/1997

* cited by examiner

*Primary Examiner*—Jesus D. Sotelo
(74) *Attorney, Agent, or Firm*—Konbbe, Martens, Olson & Bear LLP

(57) ABSTRACT

A small watercraft includes a hull, an internal combustion engine and an engine speed limiting arrangement. The hull defines an engine compartment in which the engine is supported. The engine speed limiting arrangement comprises an engine condition sensor and an electronic control unit that is operatively connected to the engine condition sensor. The engine speed limiting arrangement is configured to regulate the engine speed of the engine such that the engine speed remains between a maximum value above which the engine can be damaged and a minimum value below which the watercraft will no longer stay in a planing state. Methods for operating the engine speed limiting arrangement are also disclosed.

33 Claims, 6 Drawing Sheets

ENGINE CONTROL SYSTEM FOR WATERCRAFT

PRIORITY INFORMATION

This invention is based on and claims priority to Japanese Patent Application No. 2000-219522, filed Jul. 19, 2000, the entire contents of which is hereby expressly incorporated by reference.

BACKGROUND OF THE INVENTION

1. Field of the Invention

This invention relates to a personal watercraft, and particularly to an improved engine control system for a personal watercraft.

2. Description of the Related Art

Personal watercraft have become popular in recent years. This type of watercraft is sporting in nature and carries a rider and possibly one or more passengers. A relatively small hull of the personal watercraft commonly defines a rider's area above an engine compartment. An internal combustion engine frequently powers a jet propulsion unit that propels the watercraft. The engine lies within the engine compartment in front of a tunnel (e.g., a recess) formed on the underside of the watercraft hull. The jet propulsion is located within the tunnel and is driven by a driveshaft. The driveshaft usually extends between the engine and the jet propulsion device through a wall of the hull tunnel.

Personal watercraft often are operated in a planing state at wide open throttle. In a planning state, the hull of the personal watercraft supports the weight of a watercraft by planing or "skipping" over the surface of the water. However, if the speed of the personal watercraft suddenly decreases, the planing hull typically begins to "dig" into the water, and drag on the hull significantly increases. If the speed of the watercraft continues to drop, the watercraft hull will experience less and less planing support, and will eventually essentially operate as a displacement-type hull and the speed of the watercraft will be significantly reduced. Personal watercraft usually begin to plane at engine speeds of approximately 2000–3500 RPM.

While planing, it is not uncommon for the personal watercraft to jump out of the water. When this occurs, the engine speed suddenly increases because the hull is no longer substantially affected by water resistance. If this occurs, the engine speed can exceed a maximum value. This is generally undesirable and can result in damage to engine of the personal watercraft. As such, some personal watercraft include engine speed or "rev" limiting arrangements. In such arrangements, the engine speed is reduced when an engine speed sensor indicates that the engine is operating at an engine speed greater than the maximum value.

Personal watercraft are commonly powered by two-cycle engines, which have the advantage of being fairly powerful and relatively light and compact. However, two-cycle engines typically produce exhaust gases with relatively large quantities of carbon monoxide and various hydrocarbons. To reduce these emissions, personal watercraft typically include an exhaust system with a catalyst for cleaning the exhaust gases. One disadvantage of using a catalyst in a personal watercraft is that if the exhaust gases exceed a maximum temperature (e.g., 1000° C.), the catalyst can be damaged and/or the effectiveness of the catalyst is impaired. Such high exhaust gas temperatures can occur when the personal watercraft is planing for long periods at wide open throttle or if the engine speed suddenly increases such as when the watercraft jumps out of the water as described above.

SUMMARY OF THE INVENTION

An aspect of the present invention is the realization that prior art engine speed limiting arrangements tend to cause the personal watercraft to suddenly decelerate from the planing state. This is generally undesirable. As such, a need exists for a personal watercraft with an improved engine control system that prevents damage to the engine and/or the exhaust system without causing the personal watercraft to decelerate from the planing state.

One aspect of the present invention is a method for operating an engine speed limiting arrangement of a small watercraft. The small watercraft includes a hull, an internal combustion engine, at least one engine condition sensor and an electronic control unit, which is in electrical communication with the engine condition sensor. The hull defines an engine compartment in which the engine is supported. The method comprises sending a signal from the engine condition sensor to the electronic control unit, determining if the engine condition sensor indicates an abnormal engine condition, and regulating an engine speed of the engine such that the engine speed remains between a maximum value above which the engine can be damaged and a minimum value below which the watercraft will no longer stay in a planing state. In one modified embodiment, the engine condition sensor is a temperature sensor positioned in an exhaust system of the watercraft. In such an embodiment, the abnormal engine condition can be an exhaust gas temperature above 1000° C. In another modified embodiment, the engine condition sensor is an engine speed sensor. In such an embodiment, the abnormal engine condition can be an engine speed above 7500 revolutions per minute.

Another aspect of the present invention is a small watercraft that comprises a hull, an internal combustion engine and. an engine speed limiting arrangement. The hull defines an engine compartment in which the engine is supported. The engine speed limiting arrangement comprises an engine condition sensor and an electronic control unit that is operatively connected to the engine condition sensor. The electronic control unit is configured to receive a signal from the engine condition sensor to determine if the engine condition sensor indicates an abnormal engine condition, and to regulate the engine speed of the engine such that the engine speed remains between a maximum value above which the engine can be damaged and a minimum value below which the watercraft will no longer stay in a planing state. In one modified embodiment, the engine condition sensor is a temperature sensor positioned in an exhaust system of the watercraft. In such an embodiment, the abnormal engine condition can be an exhaust gas temperature above 1000° C. In another modified embodiment, the engine condition sensor is an engine speed sensor. In such an embodiment, the abnormal engine condition can be an engine speed above 7500 revolutions per minute.

Yet another aspect of the present invention is a small watercraft that comprises a hull, an internal combustion engine and an engine speed limiting arrangement. The hull defines an engine compartment in which the engine is supported. The engine speed limiting arrangement comprises means for regulating an engine speed of the watercraft so as to alleviate an abnormal engine condition without causing the watercraft to drop below a planing speed. In one modified embodiment, the abnormal engine condition is an exhaust gas temperature that exceeds a maximum value. In another modified embodiment, the abnormal engine condition is an engine speed that exceeds a maximum value.

Further aspects, features and advantages of the present invention will become apparent from the following description of the preferred embodiments.

BRIEF DESCRIPTION OF THE DRAWINGS

The above-mentioned and other features of the invention will now be described with reference to the drawings of preferred embodiments of the engine control system in the context of a personal watercraft. The illustrated embodiments of the engine control system are ended to illustrate, but not to limit the invention. The drawings contain 6 figures in which.

DETAILED DESCRIPTION OF THE PREFERRED EMBODIMENTS

Figure 1:
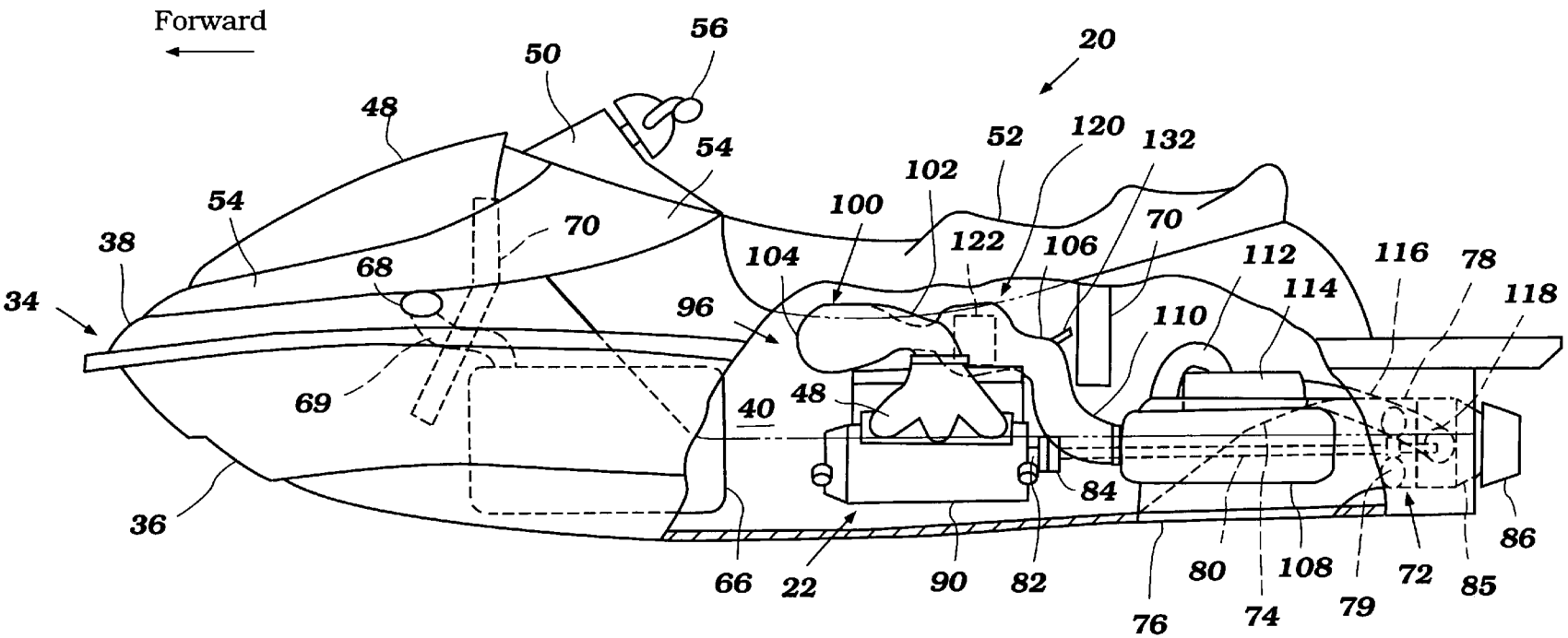
FIG. 1 is a side elevational view of a personal watercraft of the type powered by an engine with an engine control system configured in accordance with a preferred embodiment of the present invention. Several of the internal components of the watercraft (e.g., the engine) are illustrated in phantom.

With reference initially to FIG. 1, an overall configuration of a personal watercraft 20 will be described.

The watercraft 20 employs an internal combustion engine 22 with an engine control system 24 (see FIG. 2) configured in accordance with a preferred embodiment of the present invention. The described engine control system 24 has particular utility with the personal watercraft, and thus, is described in the context of the personal watercraft. However, certain features and aspects of the described engine control system 24 can be applied to other types of watercrafts as well, such as, for example, small jet boats.

The personal watercraft 20 includes a hull 34 formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40.

The upper hull section 34 includes a hatch cover 48, a control mast 50 and a seat 52 arranged from fore to aft. In the illustrated embodiment, a bow portion 54 of the upper hull section 38 slopes upwardly and an opening is provided through which the rider can access the internal cavity 40. The bow portion 54 preferably is provided with a pair of cover member pieces which are apart from one another along a center plane of the watercraft 20. Preferably, the hatch cover 48 is detachably affixed (e.g., hinged) to the bow portion 54 so as to cover the opening.

The control mast 50 extends upwardly to support a handlebar 56. The handlebar 56 is provided primarily for controlling the direction in which the water jet propels the watercraft 20. Grips are formed at both ends of the handlebar 56 so that the rider can hold them for that purpose. The handlebar 56 also carries other control units such as a throttle lever (not shown) that is used for control of the running conditions of the engine 22.

The seat 52 extends along the center plane of the watercraft to the rear of the bow portion 54. The seat 52 also generally defines the rider's area. The seat 52 has a saddle shape and hence a rider can sit on the seat 52 in a straddle-type fashion. A plurality of foot areas (not shown) are defined on both sides of the seat 52 and at the top surface of the upper hull section 38. The foot areas are formed generally flat and are surrounded by gunnels, which are formed by the lower and upper hull sections 36, 38. A cushion supported by the upper hull section 38, at least in principal part, forms the seat 52. Preferably, the seat 52 is detachably attached to the upper hull section 38. An access opening is defined under the seat 52 through which the rider can also access the internal cavity 40. That is, the seat 52 usually closes the access opening. The upper hull section 38 preferably also defines a storage box (not shown) under the seat 52.

A fuel tank 66 is disposed in the cavity 40 under the front portion of the bow portion 54. The fuel tank 66 is coupled with a fuel inlet port 68 positioned at a top surface of the upper hull section 38 through a duct 69. A closure cap (not shown) closes the fuel inlet port 68. The opening disposed under the hatch cover 48 is available for accessing the fuel tank 66.

The engine 22 is disposed in an engine compartment defined in the cavity 40. The engine compartment preferably is located under the seat 52, but other locations are also possible (e.g., beneath the control mast or in the bow.) The rider thus can access the engine 22 in the illustrated embodiment through the access opening by detaching the seat 52.

A plurality of air ducts or ventilation ducts 70 are provided on both sides of the bow portion 54 so that the ambient air can enter the internal cavity 40 therethrough. Except for the air ducts 70, the engine compartment is substantially sealed so as to protect the engine 22 and other components from water.

In the preferred embodiment, a jet pump system 72 propels the watercraft 20. The jet pump system 72 includes a tunnel 74 formed on the underside of the lower hull section 36. The tunnel 74 has a downward facing inlet port 76 opening toward the body of water. A jet pump housing 78 is disposed within a portion of the tunnel 74 and communicates with the inlet portion 76. An impeller 79 is supported within the housing 78.

An impeller shaft 80 of the jet pump system 72 extends forwardly from the impeller 79 and is coupled with a crankshaft 82 of the engine 22 by at least in part a coupling member 84. The crankshaft 82 of the engine 22 thus drives the impeller shaft 80. The rear end of the housing 78 defines a discharge nozzle 85. A steering nozzle 86 is affixed to the discharge nozzle 85 for pivotal movement about a steering axis extending generally vertically. The steering nozzle 86 is connected to the handlebar 56 by a cable (not shown) so the rider can pivot the nozzle 86.

As the engine 22 drives the impeller shaft 80 and hence rotates the impeller 79, water is drawn from the surrounding body of water through the inlet port 76. The pressure generated in the housing 78 by the impeller produces a jet of water that is discharged through the steering nozzle 86. This water jet propels the watercraft 20. The rider can move the steering nozzle 86 with the handlebar 56 when he or she desires to turn the watercraft 20 in either direction.

The engine 22 of the illustrated embodiment operates on a two-stroke crankcase compression principle. The engine 22 includes a cylinder block, which, in the illustrated embodiment, defines three cylinder bores spaced from each other from fore to aft generally along the center plane of the watercraft. However, it should be appreciated that the illustrated engine merely exemplifies one type of engine on which various aspects and features of the present invention can be used. An engine having other numbers of the cylinders, having other cylinder arrangements, other cylinder orientations (e.g., upright cylinder banks, V-type, W-type) and operating on other combustion principles (e.g., four-cycle, diesel, and rotary) are all practicable.

As is well known in the art, pistons are suitably journaled for reciprocation within the cylinder bores. A cylinder head preferably is affixed to the upper end of the cylinder block to close respective upper ends of the cylinder bores and defines three en combustion chambers with the cylinder bores and the pistons. The cylinder head can be an assembly formed by multiple members or a single head piece. Connecting rods connect the pistons to the crankshaft 82 that is housed within a crankcase member.

The cylinder block, the cylinder head, and the crankcase member together define an engine body 90. The engine body 90 preferably is made of an aluminum based alloy. In the illustrated embodiment, the engine body 90 is oriented in the engine compartment so as to position the crankshaft 82 in the center plane of the watercraft and to extend generally in the longitudinal direction. Other orientations of the engine body, of course, are also possible (e.g., with a transverse or vertical oriented crankshaft).

Preferably, a plurality of engine mounts extend from both sides of the engine body 90. The engine mounts preferably include resilient portions made of, for example, a rubber material. The engine 22 preferably is mounted on the lower hull section 36, specifically, a hull liner, by the engine mounts so that vibration of the engine 22 is inhibited from conducting to the hull section 36.

The engine 22 preferably includes an air induction system to introduce air to the combustion chambers. In a preferred embodiment, the air induction system includes a plurality of throttle bodies that are each associated with a cylinder bore of the engine 22. The throttle bodies are connected to the crankcase member by an intake conduit, such as, for example, a manifold, which preferably is made of a resilient, flexible material (e.g., rubber).

Each of the throttle bodies includes a throttle valve. Pivotal movement of the throttle valves is controlled by the throttle lever on the handlebar 56 through a control cable that is connected to set of throttle valve shafts. The rider thus can control an opening amount of the throttle valves by operating the throttle lever so as to obtain various running conditions of the engine 22 that the rider desires. That is, an amount of air passing through the throttle bodies is controlled by this mechanism.

A reed valve selectively allows air into the crankcase member from the throttle bodies and manifold. The crankcase member itself is compartmentalized to provide the crankcase compression features for each combustion chamber as is well known in the operation of two-cycle engines. The charge within the crankcase member is delivered to each combustion chamber through several scavenge passages formed in the cylinder block. The scavenge passages terminate at a number of scavenge ports formed on the cylinder bore.

The air induction system preferably also includes at least one air intake box, which supplies air to the throttle bodies. The intake box forms a "plenum chamber" for smoothing the intake air and acting as an intake silencer.

The engine 22 includes a fuel supply system, which includes the fuel tank 66 and a plurality of fuel injectors. In a preferred embodiment, the fuel injectors are mounted to the throttle bodies such that the fuel injectors spray fuel directly into the throttle bodies. Fuel delivery conduits are arranged to supply fuel to the fuel injectors. In one variation, the fuel delivery conduits comprise a fuel rail to which the fuel injectors are attached. In another variations, the fuel delivery conduits can be fuel lines that are connected to the fuel injectors. These fuel lines can be arranged in series or in parallel.

Those of skill in the art will recognize that the fuel injection system described above is an indirect fuel injection system. That is, the fuel is injected into the induction system of the engine. However, it should be appreciated that in some arrangements the engine could utilize a direct fuel injection system (i.e., a fuel system where fuel is directly injected into the combustion chamber). In other arrangements, the engine can utilize a carburetor, which delivers a generally constant air/fuel ratio during a given intake cycle.

The fuel injectors 91 (FIG. 2) spray the fuel into the throttle bodies at an injection timing and duration under control of an electronic control unit (ECU) 92 (see FIG. 2), which, as will be explained in more detail below, forms part of the engine control system 24. During normal operation, the ECU 92 can control the injection timing and duration according to any known fuel control strategy, which preferably responds to a signal from at least one engine sensor, such as, for example, but without limitation, a throttle valve position sensor (not shown).

Ignition elements 93 (FIG. 2) in the form of, for example, spark plugs are mounted within the cylinder head with their gaps extending into the combustion chambers. During normal operation, the spark plugs are fired by an ignition control unit that is controlled the ECU of the engine 22 according to any known fuel control strategy. The spark plugs are connected to the ignition control unit by spark plug leads (not shown).

An exhaust system 96 (FIG. 2) is provided for discharging exhaust gases from the engine 22 to the atmosphere and/or to the water. The exhaust system 96 preferably includes exhaust passages (not shown) that are associated each combustion chamber and are formed in the cylinder block. In some arrangements, a sliding type exhaust timing control valve can be provided in the exhaust passages for controlling the timing of the opening and closing of the exhaust passages as is known in the art.

The exhaust system 96 preferably also includes an exhaust manifold 98, which in the illustrated embodiment is affixed to the port side of the engine body 90. The outlet of the exhaust manifold 98 communicates with an expansion chamber 100, which includes an upstream section 102 and a C-shaped downstream section 104. The upstream section 102 is directly connected to the outlet of the exhaust, manifold and extends upwardly and forwardly to the C-shaped downstream section 104. The C-shaped downstream section 104, in turn, wraps around the front of the engine 22 and extends along the starboard side of the engine 22 at an elevation that preferably is generally at or above to the cylinder head. The outlet of the C-shaped section 104 extends generally rearwardly along the starboard side of the engine 22 and is connected to an exhaust pipe 106.

The exhaust pipe 106 preferably is connected to a first water trap device 108 through a conduit 110. The first water trap device 108 inhibits the back flow of water into the exhaust pipe 106 and into the exhaust system 96 in general. A second exhaust pipe 112 preferably couples to a second water trap device 114. In the illustrated embodiment, the second water trap device 114 is located on a side of the jet pump system 72 opposite the first water trap device 108. As such, the illustrated second exhaust pipe 112 extends up and over the jet pump system 72 and thus further inhibits the influx of water into the exhaust system 96. In the illustrated embodiment, a third exhaust pipe 116 couples the second water trap device 114 to a discharge opening 118 for discharging the exhaust gases to a body of water in which the personal watercraft 20 is operating.

In the illustrated embodiment, a catalyst assembly 120 is provided between the C-shaped downstream section 104 and the exhaust pipe 106. Preferably, the catalyst assembly 120 includes a catalyst 122, such as, for example, a honeycombed-type catalyst bed designed for treating hydrocarbons, carbon monoxide and nitrogen oxides. The exhaust system 96 preferably includes a cooling jacket, which defines cooling passages (not shown) that surround the outlet of the C-shaped downstream section 104, the catalyst assembly 120 and the exhaust pipe 106. The cooling passages serve to cool the exhaust gases before they are discharged.

The engine 22 also preferably includes a lubricating system for providing lubricant to various engine parts and a cooling system for cooling the engine 22. These systems are well known in the art.

Figure 2:
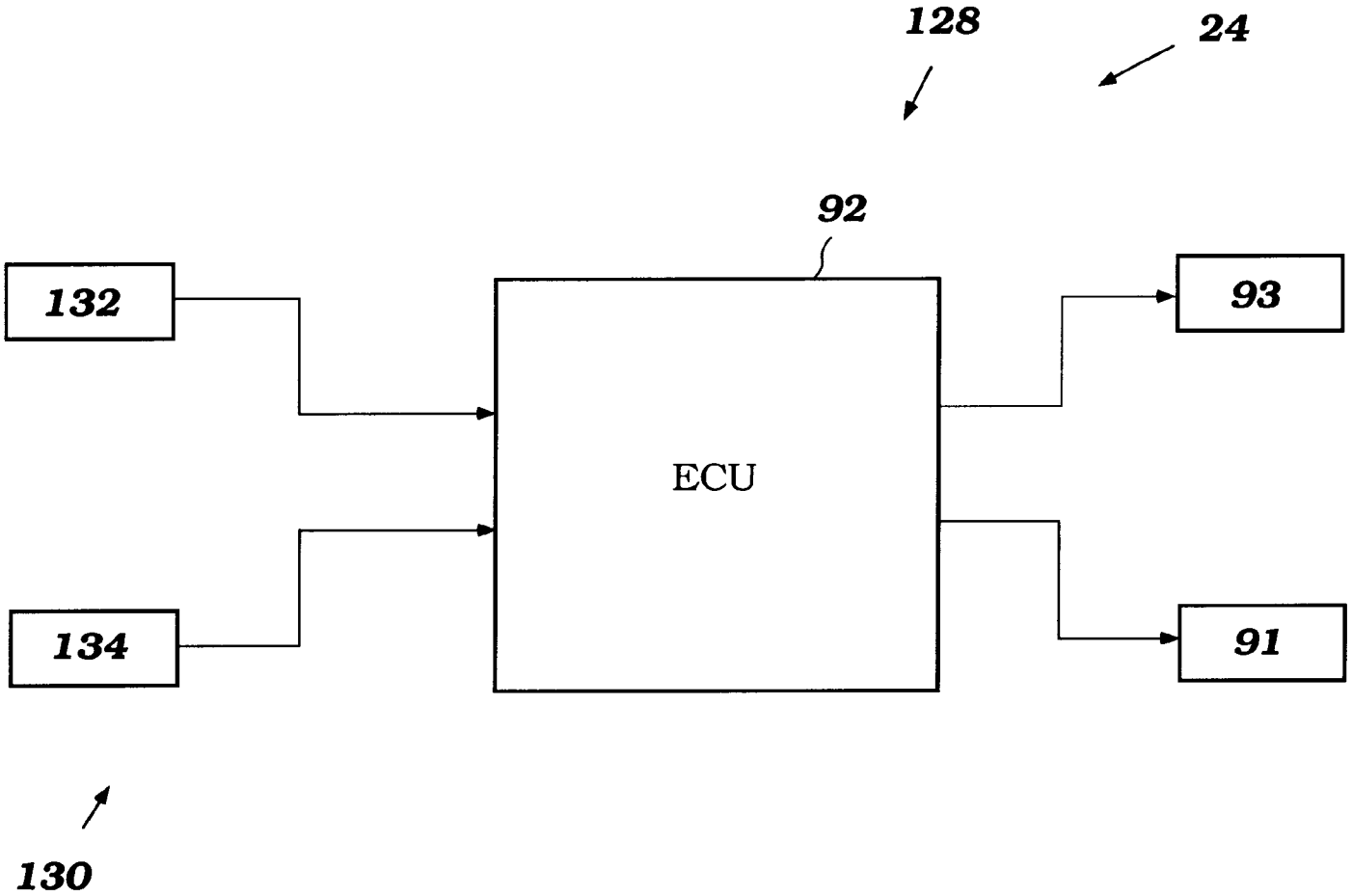
FIG. 2 is a schematic illustration of the engine control system having certain features and aspects of the present invention.

FIG. 2 is a schematic illustration a portion of the engine control system 24. The engine control system 24 generally comprises the ECU 92 and various actuators and sensors that are operatively connected to the ECU 92. The engine control system controls 24 various aspects of engine operation. For example, as mentioned above, during normal operation, the engine control system 24 controls the firing of the spark plugs 93 and the injection timing and duration of the fuel injectors 91. As is well known, to appropriately control the engine 22 under various operating conditions, the engine control system 24 preferably utilizes maps and/or indices stored within the memory of the ECU 92 with reference to data collected from various sensors. For example, the engine control system 24 may refer to data collected from a throttle valve position sensor and other sensors provided for sensing engine running conditions, ambient conditions or conditions of the watercraft 20 that may affect engine performance.

It should be noted that the ECU 92 may be in the form of a hard-wired feedback control circuit that performs the operations described below. Alternatively, the ECU 92 may be constructed of a dedicated processor and a memory for storing a computer program configured to perform the operations described below. Additionally, the ECU 92 may be a general purpose computer having a general purpose process and the memory for storing a computer program for performing the operations described below.

The portion of the engine control system 24 illustrated in FIG. 2 is an engine speed limiting arrangement 128 configured so as to reduce the engine speed of the engine 22 in response to an abnormal engine condition. Preferably, the engine speed limiting arrangement 128 is configured such that when an abnormal engine condition is sensed the engine speed is reduced only to such an extent that watercraft 20 will remain in a planing state. In the illustrated embodiment, the engine speed is reduced by sequentially disabling cylinders of the engine 22. While the cylinders are being sequentially disabled, the engine speed limiting arrangement monitors engine conditions and prevents the watercraft 20 from leaving the planing state.

As shown in FIG. 2, the engine speed limiting arrangement 128 includes one or more engine condition sensors 130. In the illustrated embodiment, the engine condition sensors 130 include an exhaust gas temperature sensor 132 and an engine speed sensor 134. The exhaust gas temperature 132 is configured to indicate the temperature of the exhaust gases. As such, the exhaust gas temperature sensor 132 is preferably disposed within the exhaust gas system 96. As shown in FIG. 1, in the illustrated embodiment, the exhaust gas temperature sensor 132 is positioned in the exhaust pipe 106.

The engine speed sensor 134 is configured to sense the engine speed of the engine 22. For example, in some arrangements, the engine speed sensor 134 can be configured to sense the rotational speed of the crankshaft 82 through, by way of example, sensing the rotation of a pulsar coil. In other arrangements, such as, for example, in a watercraft that utilizes a four-cycle engine with overhead camshafts, the engine speed sensor 134 can be configured to sense the rotation speed of one of the camshafts.

In the illustrated embodiment, the engine speed limiting arrangement 128 is a subsystem of the engine control system 24. That is, the engine speed limiting arrangement 128 shares several components with the engine control system 24, such as, for example, the ECU 92 and the engine speed sensor 134 and the exhaust gas temperature sensor 132. However, it should be appreciated that the engine speed limiting arrangement 128 could include separate components or be entirely separate from the engine control system 24. Preferably, the engine speed limiting arrangement is a subsystem of the engine control system 24 because this arrangement reduces the number of parts and the cost of the watercraft 20.

Figure 3:
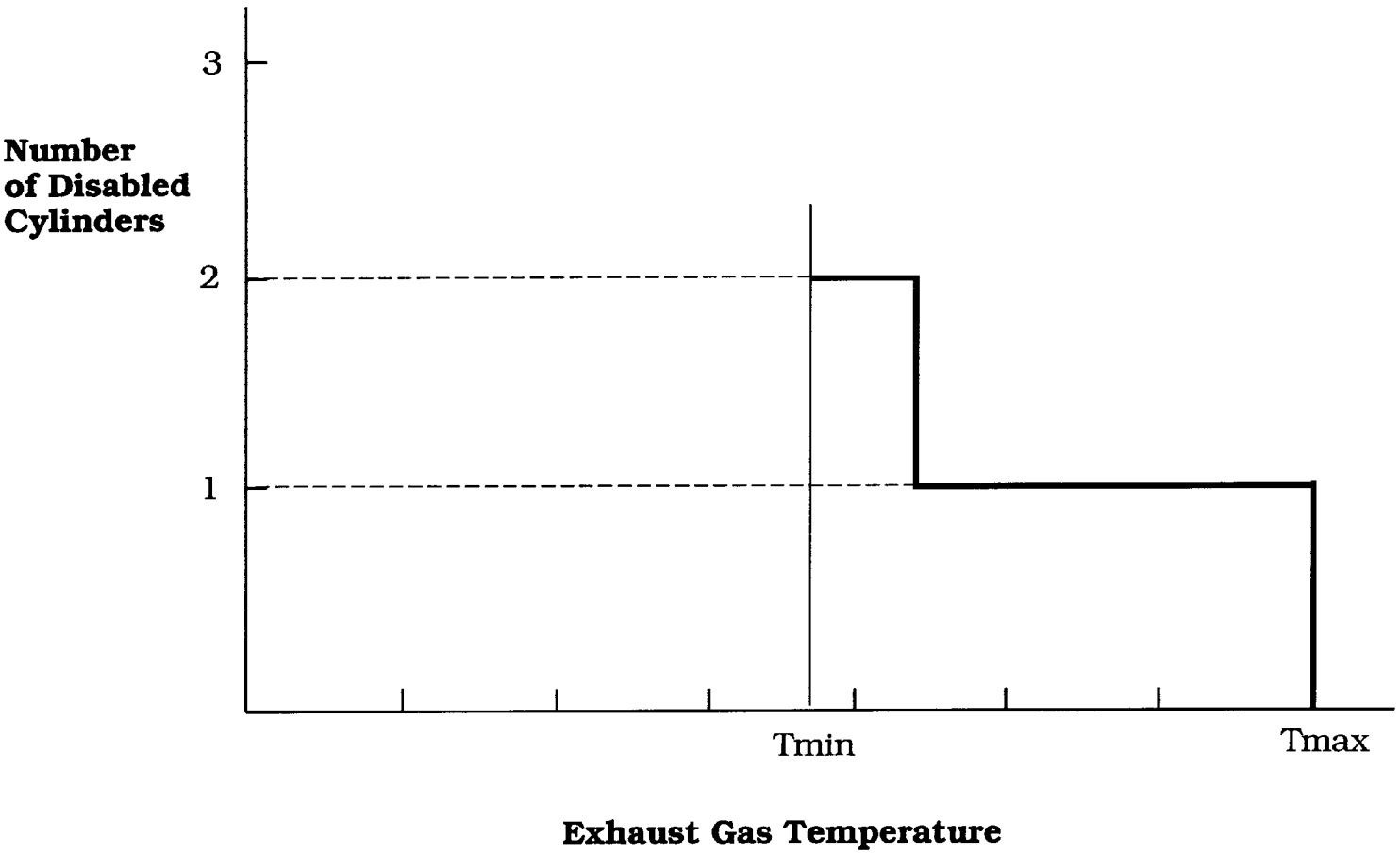
FIG. 3 is a graphical illustration of the exhaust gas temperature in the personal watercrat of FIG. 1 when the watercraft is operated according to certain features and aspects of the present invention.

FIG. 3 illustrates a graphical depiction of a control arrangement having certain features and aspects of the present invention. In this arrangement, when the exhaust gas temperature exceeds a maximum temperature Tmax, one of the cylinders of the engine 22 is disabled. By disabling one of the cylinders, the engine speed is reduced. For example, if the engine is operating at wide open throttle at an engine speed of approximately 7500 revolutions per minute (RPM), disabling one cylinder will gradually reduce the engine speed to, for example, approximately 6000 RPM. As the engine speed is reduced, the temperature of the exhaust gas is reduced. If the exhaust gas temperature is reduced to a minimum temperature Tmin within a predetermined amount of time, operation of the disabled cylinder can be resumed. If the exhaust gas temperature is not reduced to the minimum temperature Tmin within the predetermined amount of time, a second cylinder is preferably disabled. Disabling a second cylinder will reduce the engine speed from, for example, approximately 6000 RPM to approximately 4000 RPM at wide open throttle. In a similar manner, a third cylinder can be disabled to effectively shut off the engine if the exhaust gas temperature remains above the minimum temperature Tmin. In other arrangements with more than three cylinders, more than three cylinders can be disabled in a manner similar to that described above.

In general, disabling a cylinder means that the ECU 92 prevents an ignition element 93 (e.g., a spark plug in the illustrated embodiment) from firing so as to prevent combustion in that cylinder. In some arrangements, the ECU 92 may also prevent fuel from being injected through the fuel injector 91 into the cylinder that is being disabled. Such an arrangement helps to prevent fouling of the sparkplug 93 and reduces "blow-by" of unburned fuel into the exhaust gases.

In the preferred arrangement, the maximum temperature Tmax is an exhaust gas temperature at which the catalyst 122 can be damaged and/or the effectiveness of the catalyst 122 is impaired. In some arrangements, the maximum temperature Tmax can correspond to an exhaust gas temperature that indicates when the engine speed is greater than a maximum engine speed Rmax. Such a maximum temperature Tmax can be determined empirically, through modeling and/or experiments. In the illustrated embodiment, the maximum temperature is approximately 1000° C., which corresponds to an engine speed of approximately 7500 revolutions per minute (RPM) at wide open throttle.

In a similar manner, in the preferred arrangement, the minimum temperature is an exhaust temperature at which the catalyst 122 will no longer be damaged and/or the effectiveness of the catalyst 122 is no longer impaired. Moreover, the minimum temperature also corresponds to an engine speed at which the watercraft 20 will still remain in a planing state. Such a minimum temperature can also be determined empirically, through modeling and/or experiments. As mentioned above, personal watercraft typically begin to plane at engine speeds of approximately 2000–3500 RPM. In the illustrated embodiment, the minimum temperature is approximately 800° C., which corresponds to an engine speed of approximately 3500 RPM such that the watercraft 22 will remain in a planing state.

Figure 4:
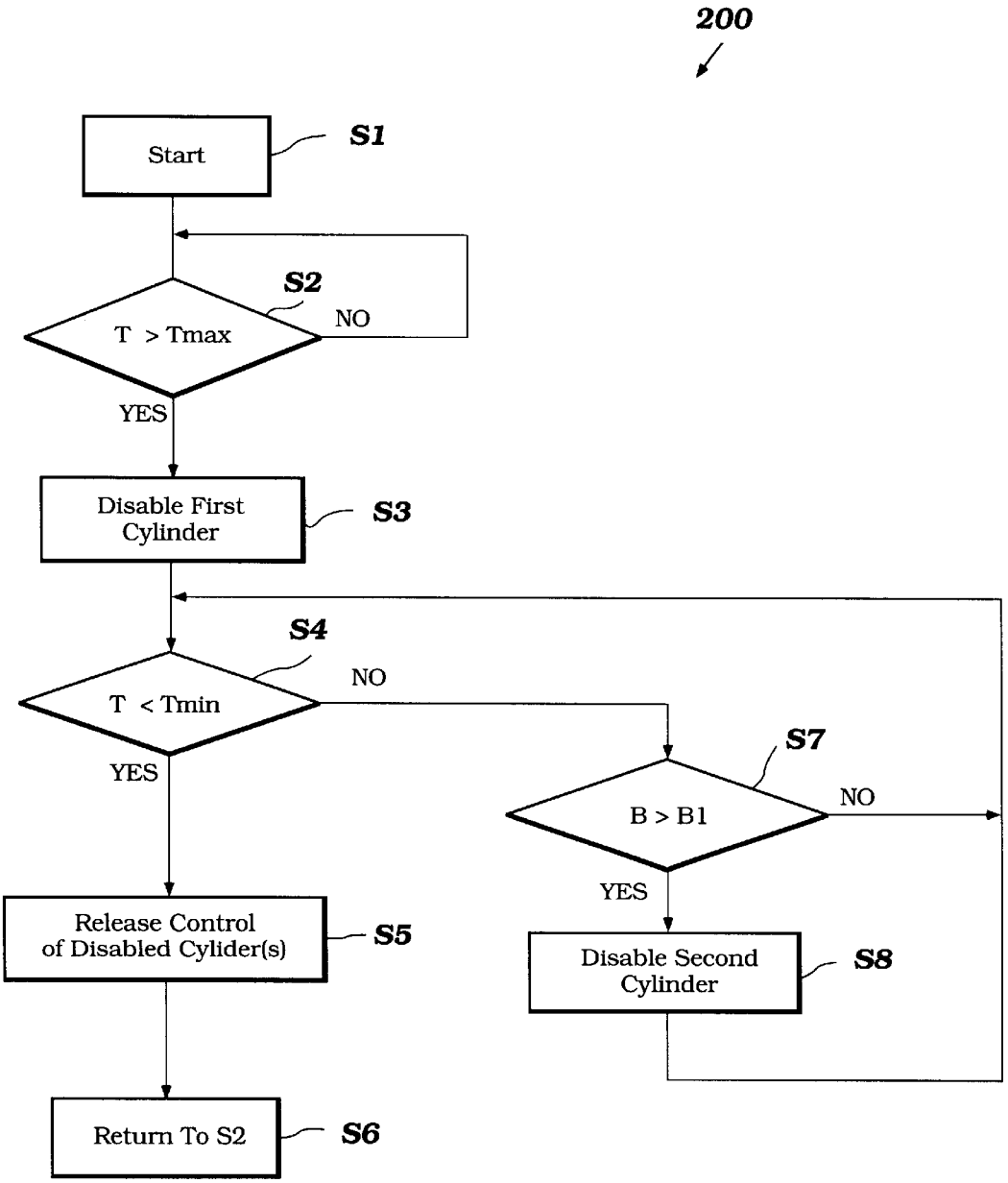
FIG. 4 is flow diagram illustrating a control routine having certain features and advantages according to the present invention.

FIG. 4 illustrates a control routine 200 that is capable of implementing a control strategy that can achieve control similar to that described graphically in FIG. 3 is illustrated therein. The control routine 200 preferably is executed by the ECU 92. As shown in FIG. 4 and as represented by an operational block S1, the routine 200 preferably starts when a main switch of the watercraft 20 is turned on. The routine 200 then determines if the exhaust gas temperature is greater than the maximum temperature Tmax as represented by a decisional block S2. Preferably, this involves receiving a signal from the exhaust gas temperature sensor 132. If the exhaust gas temperature is less than the maximum temperature Tmax, then the routine 200 continues to determine if the exhaust gas temperature is greater than the maximum temperature Tmax.

If the exhaust gas temperature is greater than the maximum temperature Tmax, then one of the cylinders is disabled as represented by an operational block S3. Preferably, this involves preventing the ignition element 93 from firing so as to prevent combustion within the disabled cylinder. More preferably, the ECU 92 also prevents fuel from being injected through the fuel injector 91 and into the disabled cylinder. In this manner, the engine speed of the watercraft 22 and the exhaust gas temperature will be decreased. After the first cylinder is disabled, the routine 200 then determines if the exhaust gas temperature is less than the minimum temperature Tmin as represented by a decisional block S4. If the exhaust gas temperature is less than the minimum temperature Tmin, the routine 200 releases control of any disabled cylinder and allows the ignition element 93 to start combustion in the formerly disabled cylinder as represented by an operational block S5. If fuel injection has been stopped, the routine also allows fuel to be injected into the formerly disabled cylinder. In this manner, the engine speed no longer decreases and the watercraft 20 is maintained in the planing state. The routine 200 continues to monitor the temperature of the exhaust gas as indicated by an operational block S6, which returns the routine 200 to the decisional block S2.

If the routine 200 determines that the exhaust gas temperature is greater than the minimum temperature Tmin, then the routine 200 determines if a predetermined amount of time B1 has passed as represented by a decisional block S7. In a preferred arrangement, the predetermined amount of time is approximately 5 seconds. If the predetermined amount of time B1 has not passed, the routine 200 preferably loops back to the decisional block S4. If the predetermined amount of time B1 has passed, a second cylinder is disabled as indicated by an operational block S8. After the second cylinder is disabled the routine loops back to the decisional block S4. It should be appreciated that the routine 200 described above can be modified to sequentially disable all the cylinders of the engine 22 in a manner similar to that of the first two cylinders.

Figure 5:
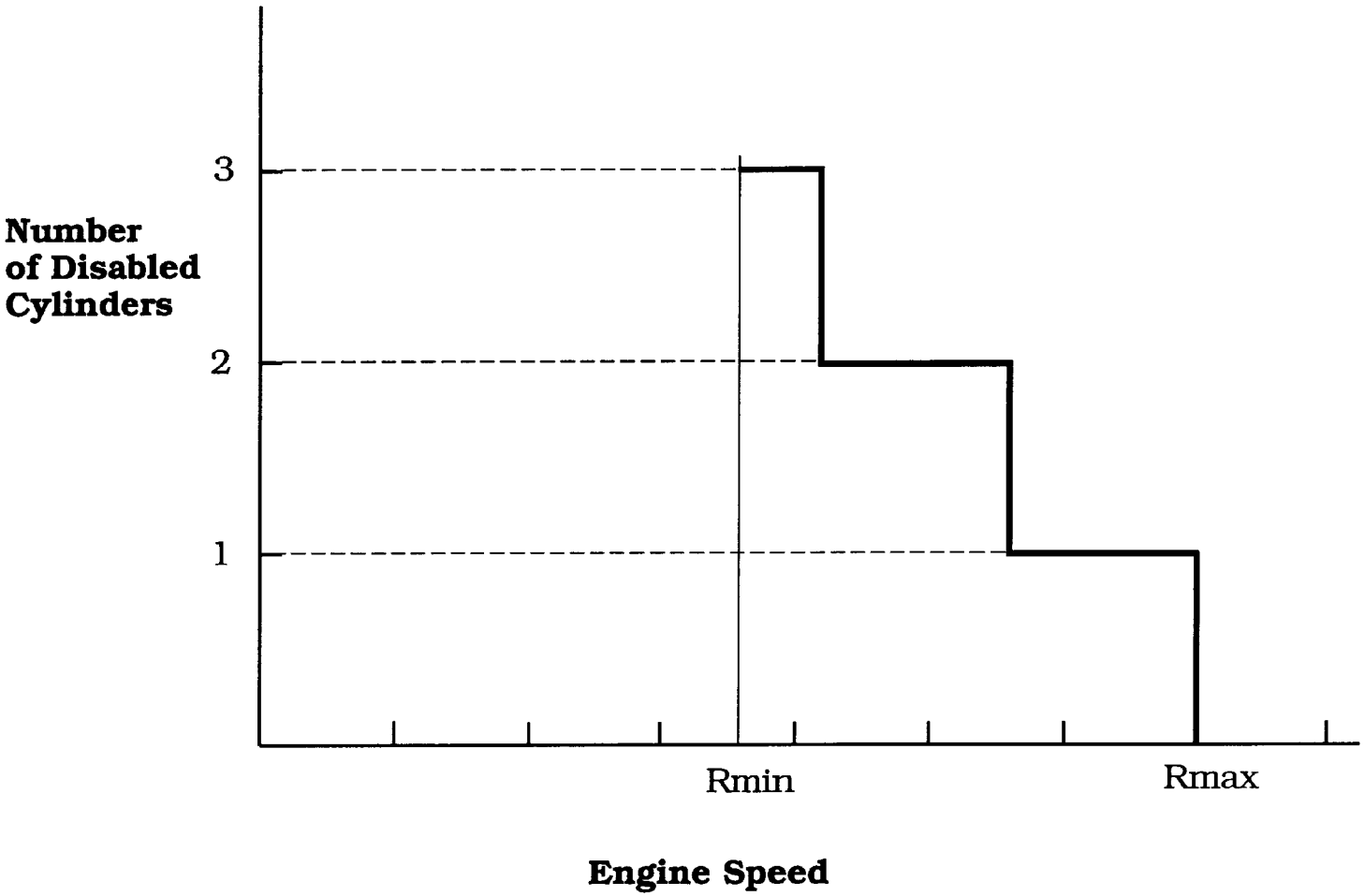
FIG. 5 is a graphical illustration of the engine speed of the personal watercraft of FIG. 1 when the watercraft is operated according to certain features and aspects of the present invention.

FIG. 5 illustrates a graphical depiction of a modified control arrangement having certain features and aspects of the present invention. In this arrangement, when the engine speed exceeds a maximum engine speed Rmax, one of the cylinders of the engine 22 is disabled, which reduces the engine speed as described above If the engine speed is reduced to a minimum engine speed Rmin within a predetermined amount of time, operation of the disabled cylinder can be resumed. If the engine speed is not reduced to the minimum engine speed Rmin within the predetermined amount of time, a second cylinder is disabled. In a similar manner, a third can be disabled. In other arrangements with more than three cylinders can be disabled in a manner similar to that described above. Preferably, at the minimum engine speed Rmin, the watercraft 20 remains in a planing state.

In the preferred arrangement, the maximum engine speed Rmax is an engine speed above which the engine will be damaged. Such an engine speed can be determined empirically, through modeling and/or experiments. In the illustrated embodiment, the maximum engine speed Rmax is approximately 7500 RPM. The minimum engine speed Rmin is an engine speed at which the engine will no longer be damaged and at which the watercraft 20 will still remain in a planing state. That is, the minimum engine speed Rmin preferably is between Rmax and an engine speed at which the watercraft will cease planing, such as, for example, approximately 3500 RPM. Such a minimum engine speed can also be determined empirically, through modeling and/or experiments. In the illustrated embodiment, the minimum engine speed Rmin is approximately 7300 RPM.

Figure 6:
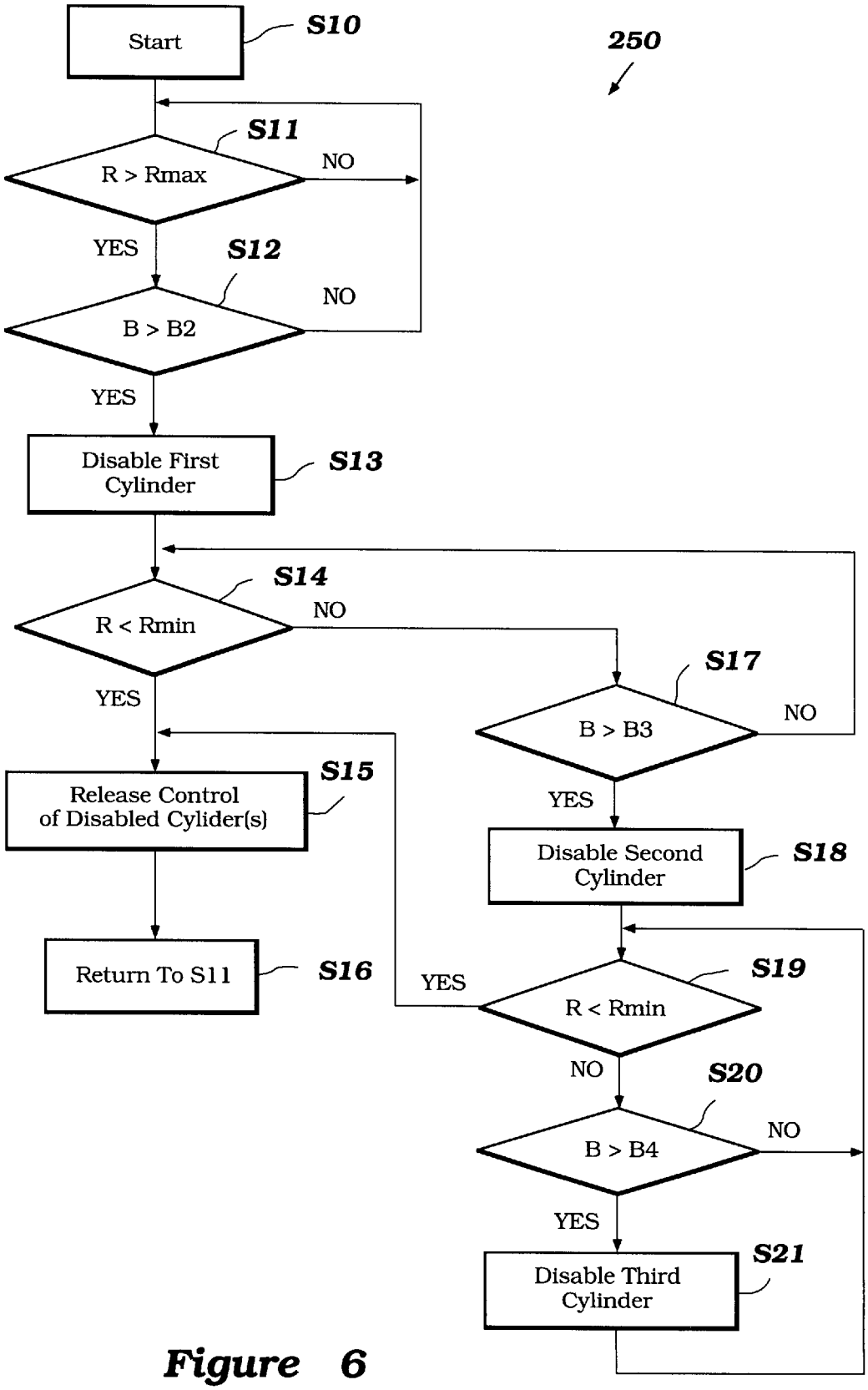
FIG. 6 is flow diagram illustrating another control routine having certain features and advantages according to the present invention.

FIG. 6 illustrates a control routine 250 that is capable of implementing a control strategy that can achieve control similar to that described graphically in FIG. 5. As shown in FIG. 6 and as represented by an operational block S10, the routine 250 preferably starts when a main switch of the watercraft 20 is turned on. The routine 250 then determines if the engine speed is greater than the maximum engine speed Rmax as represented by a decisional block S11. Preferably, this involves receiving a signal from the engine speed sensor 134. If the engine speed is less than the maximum engine speed Rmax, then the routine 250 continues to determine if the engine speed is greater than the maximum engine speed Rmax.

If the engine speed is greater than the maximum engine speed Rmax, then the routine 250 determines if a predetermined amount of time B2 has passed as represented in a decisional block S12. In a preferred arrangement, the predetermined amount of time B2 is approximately 0.1 seconds. If the predetermined amount of time has not passed, the routine 250 loops back to the decisional block S11. If the predetermined amount of time has passed, one of the cylinders is disabled as indicated by an operational block S13. As such, in the illustrated embodiment, one of the cylinders is disabled only if the engine speed is greater than the maximum engine speed Rmax for a predetermined amount of time. If the engine speed is greater than the maximum engine speed Rmax for less than the predetermined amount of time, then one of the cylinders is not disabled. This arrangement is preferred because operating above the maximum engine speed for less than the predetermined amount of time is unlikely to cause significant damage to the engine and steps taken to reduce the engine speed may result in engine hunting.

After the first cylinder is disabled, the routine 250 then determines if the engine speed is less than the minimum engine speed Rmin as represented in a decisional block S14. If the engine speed is less than the minimum engine speed Rmin, then the routine 250 releases control of any disabled cylinder. In this manner, the engine speed no longer decreases and the watercraft 20 is maintained in the planing state. The routine 250 continues to monitor engine speed as indicated by an operational block S16, which returns the routine 250 to the decisional block S11.

If the routine 250 determines that the engine speed is greater than the minimum engine speed Rmin, then the routine 250 determines if another predetermined amount of time B3 has passed as represented by a decisional block S17. In a preferred embodiment, this predetermined amount of time is also approximately 0.1 seconds. If the predetermined amount of time B3 has not passed, the routine 250 preferably loops back to the decisional block S14. If the predetermined amount of time B3 has passed, a second cylinder is disabled as indicated by an operational block S18.

After the second cylinder is disabled, the routine 250 preferably again determines if the engine speed is less than the minimum engine speed Rmin as indicated by a decisional block S19. If the engine speed is less than the minimum engine speed Rmin, then the disabled cylinders are enabled as indicated by an operational block S15. If the engine speed is still greater than the minimum engine speed Rmin, then the routine determines if another predetermined amount of time B4 has passed as represented by a decisional block S20. In the illustrated embodiment, the predetermined amount of time B4 is also 0.1 seconds. If the predetermined amount of time has not passed, the routine 250 loops back to the decisional block S19. If the predetermined amount of time has passed, the third cylinder is disabled. In the illustrated embodiment wherein the engine has three cylinders, this effectively shuts off the engine. Of course, the routine 250 can be modified to sequentially disable all the cylinders of an engine with more or less than three cylinders.

Of course, the foregoing description is that of preferred embodiments of the invention and various changes, modifications and combinations may be made without departing from the spirit and scope of the invention, as defined by the appended claims.

What is claimed is:

1. A method for operating an engine speed limiting arrangement for a small watercraft that includes a hull defining an engine compartment, an internal combustion engine supported within the engine compartment, at least one engine condition sensor and an electronic control unit that is in electrical communication with the engine condition sensor, the method comprising:

sending a signal from the engine condition sensor to the electronic control unit, determining if the engine condition sensor indicates an abnormal engine condition, and regulating an engine speed of the engine such that the engine speed remains between a maximum value above which the engine can be damaged and a minimum value below which the watercraft will no longer stay in a planing state.

2. The method as in claim 1, wherein the engine condition sensor is a temperature sensor positioned within an exhaust system of the watercraft and the signal indicates an exhaust gas temperature.

3. The method as in claim 2, wherein the temperature sensor is disposed within an exhaust pipe of the exhaust system.

4. The method as in claim 2, wherein the step of determining if the engine condition sensor indicates an abnormal condition comprises determining if the exhaust gas temperature exceeds a maximum value.

5. The method as in claim 4, wherein the maximum value is approximately 1000° C.

6. The method as in claim 1, wherein the engine condition sensor is an engine speed sensor and the signal indicates an engine speed of the engine.

7. The method as in claim 6, wherein the step of determining if the abnormal condition sensor indicates an abnormal condition comprises determining if the engine speed exceeds a maximum value.

8. The method as in claim 6, wherein the maximum engine value is approximately 7500 revolutions per minute.

9. The method as in claim 1, wherein the step of regulating the engine speed of the engine such that the engine speed remains between a maximum value above which the engine can be damaged and a minimum value below which the watercraft will no longer stay in a planing state comprises disabling at least one cylinder of the engine.

10. The method as in claim 9, where the step of disabling at least one cylinder comprises preventing an ignition element within at least one cylinder from firing.

11. The method as in claim 9, where the step of disabling at least one cylinder comprises stopping injection of fuel into at least one cylinder.

12. The method as in claim 9, wherein the step of regulating the engine speed of the engine such that the engine speed remains between a maximum value above which the engine can be damaged and a minimum value below which the watercraft will no longer stay in a planing state comprises resuming the operation of at least one cylinder that has been disabled if the engine condition sensor indicates that the engine condition is below a minimum value.

13. The method as in claim 12, wherein the engine condition is an engine speed of the engine and the minimum value is approximately 7300 revolutions per minute.

14. The method as in claim 12, wherein the engine condition is an exhaust gas temperature of the engine and the minimum value is 800° C.

15. The method as in claim 1, wherein the step of regulating the engine speed of the engine such that the engine speed remains between a maximum value above which the engine can be damaged and a minimum value below which the watercraft will no longer stay in a planing state comprises disabling at least one cylinder if the abnormal engine condition exists for more than a predetermined amount of time.

16. A small watercraft comprising a hull defining an engine compartment, an internal combustion engine supported within the engine compartment, and an engine speed limiting arrangement comprising an engine condition sensor and an electronic control unit that is operatively connected to the engine condition sensor, the electronic control unit configured to receive a signal from the engine condition sensor, to determine if the engine condition sensor indicates an abnormal engine condition, and to regulate the engine speed of the engine such that the engine speed remains between a maximum value above which the engine can be damaged and a minimum value below which the watercraft will no longer stay in a planing state.

17. The watercraft as in claim 16, wherein the engine includes an exhaust system and the engine condition sensor is an exhaust gas temperature sensor.

18. The watercraft as in claim 17, wherein the exhaust gas temperature sensor is positioned in an exhaust pipe of the exhaust system.

19. The watercraft as in claim 17, wherein the electronic control unit is configured to determine if the engine condition sensor indicates an abnormal engine condition by determining if the exhaust gas temperature exceeds a maximum value.

20. The watercraft as in claim 19, wherein the maximum value is 1000° C.

21. The watercraft as in claim 16, wherein the engine condition sensor is an engine speed sensor.

22. The watercraft as in claim 21, wherein the electronic control unit is configured to determine if the engine condition sensor indicates an abnormal engine condition by determining if the engine speed exceeds a maximum value.

23. The watercraft as in claim 22, wherein the maximum value is 7500 revolutions per minute.

24. The watercraft as in claim 16, wherein the electronic control unit is configured to regulate the engine speed by disabling at least one cylinder of the engine.

25. The watercraft as in claim 24, wherein the electronic control unit is configured disable at least one cylinder by preventing an ignition element within at least one cylinder from firing.

26. The watercraft as in claim 25, wherein the electronic control unit is configured to disable at least one cylinder by stopping injection of fuel into at least one cylinder.

27. The watercraft as in claim 24, wherein the electronic control unit is configured to regulate the engine speed by resuming the operation of at least one cylinder that has been disabled if the engine condition sensor indicates that the engine condition is below a minimum value.

28. The watercraft as in claim 27, wherein the engine condition sensor is an engine speed sensor and the minimum value is approximately 7300 revolutions per minute.

29. The watercraft as in claim 27, wherein the engine condition sensor is an exhaust gas temperature sensor of and the minimum value is 800° C.

30. The watercraft as in claim 16, wherein the electronic control unit is configured to regulate the engine speed by disabling at least one cylinder if the abnormal engine condition exists for more than a predetermined amount of time.

31. A small watercraft comprising a hull defining an engine compartment, an internal combustion engine supported within the engine compartment, and an engine speed limiting arrangement comprising means for regulating an engine speed of the watercraft so, as to alleviate an abnormal engine condition without causing the watercraft to drop below a planing speed.

32. The small watercraft as in claim 31, wherein the abnormal engine condition is an exhaust gas temperature that exceeds a maximum value.

33. The small watercraft as in claim 31, wherein the abnormal engine condition is an engine speed that exceeds a maximum value.

* * * * *

UNITED STATES PATENT AND TRADEMARK OFFICE

CERTIFICATE OF CORRECTION

PATENT NO. : 6,517,394 B2
DATED : February 11, 2003
INVENTOR(S) : Ozawa, Shigeyuki It is certified that error appears in the above-identified patent and that said Letters Patent is hereby corrected as shown below:

Title page,
Item [75], change “Iwata” to -- Shizuoka --.

Signed and Sealed this

Twenty-sixth Day of August, 2003

JAMES E. ROGAN
*Director of the United States Patent and Trademark Office*